United States Patent [19]

Helmer et al.

[11] Patent Number: 4,816,073

[45] **Date of Patent: * Mar. 28, 1989**

[54] AQUEOUS DISPERSIONS, A PROCESS FOR THEIR PREPARATION AND THE USE OF THE DISPERSIONS AS SIZING AGENTS

[75] Inventors: Ulla Helmer, Solna; Randi Johansen, Bromma; Ulf Carlson, Gothenburg, all of Sweden

[73] Assignee: Casco Nobel AB, Stockholm, Sweden

[ * ] Notice: The portion of the term of this patent subsequent to May 10, 2005 has been disclaimed.

[21] Appl. No.: 137,821

[22] Filed: Dec. 24, 1987

[51] Int. Cl.[4] ..... C08J 3/02; B32B 9/06

[52] U.S. Cl. ..... 106/238; 162/164.1; 428/498; 428/537.5

[58] Field of Search ..... 106/218, 238; 162/164.1; 428/537.5, 498

[56] References Cited

U.S. PATENT DOCUMENTS 4,147,682 4/1979 Yada et al. ..... 162/164.1
4,743,303 5/1988 Helmer et al. ..... 106/238

*Primary Examiner*—Theodore Morris
*Attorney, Agent, or Firm*—Fred Philpitt

[57] ABSTRACT

Aqueous dispersions of rosin and synthetic sizing agent wherein the particles in the dispersed phase contain a mixture of rosin and the synthetic sizing agent and wherein the dispersions contain a polyaluminum compound. The dispersions are prepared by homogenization of a homogenous mixture of rosin material and the synthetic sizing agent and the polyaluminum compound can either be present at the production or be added to an aqueous dispersion of mixed particles. The dispersions are used as sizing agents at the production of paper, paper board, board and similar products.

13 Claims, No Drawings

AQUEOUS DISPERSIONS, A PROCESS FOR THEIR PREPARATION AND THE USE OF THE DISPERSIONS AS SIZING AGENTS

The present invention relates to aqueous dispersions of rosin and synthetic cellulose-reactive sizing agents which dispersions contain polyaluminum compounds. More particularly the invention relates to such dispersions wherein the particles in the dispersed phase contain a mixture of rosin and the synthetic sizing agent. The invention also relates to a method for the preparation of the dispersions and to their use as hydrophobing agents in the production of paper, board and similar products.

One of the most essential properties of paper, paperboard and similar products is the resistance to penetration by water and other liquids. The two main methods for conferring hydrophobic properties to paper products are internal sizing and surface sizing. Internal sizing gives a hydrophobic effect in the entire paper structure while the effect of surface sizing is more or less limited to the actual surface structure and the two methods can be used in combination.

Internal sizing is the addition of suitable chemicals to the cellulose stock and these chemicals are either adsorbed on the cellulose or react with this. In internal sizing rosin, which is fixed to the cellulose by precipitation with alum, or synthetic sizing agents, such as alkyl ketene dimers, isocyanates, acid anhydrides and carbamoyl chlorides, are mainly used.

Rosin was earlier mainly used in the form of so-called paste size but for some time now the development has gone towards the use of rosin in the form of aqueous dispersions of rosin with high free rosin content and with very small particle size. Such dispersions are prepared by means of differently charged emulsifiers, as disclosed for example in the U.S. Pat. No. 3,817,768 and the British Pat. No. 1551645.

Internal sizing with rosin certainly gives the finished paper product good resistance to penetration by water, but often it does not give sufficient resistance to penetration by acid liquids, such as lactic acid, which limits the usefulness of paper and board sized with rosin. As an internal size rosin also has certain drawbacks in the form of limitations with regard to the pH and the temperature of the stock. Rosin has a further disadvantage in that it must be used in comparatively high amounts to give a satisfactory sizing effect. Fortification of rosin, ie reaction with an $\alpha,\beta$-unsaturated polybasic acid, or anhydride thereof, such as fumaric acid, maleic acid and itaconic acid, or anhydrides thereof, increases the hydrophobing effect. However, increased degree of fortification results in an increase in the softening point and viscosity of the melted rosin phase and this means that very high temperatures are required at the preparation of such rosin dispersions, which is undesirable both from an economical and a technical point of view. A too high softening point for the rosin material also gives an impaired sizing effect and fortification of rosin in order to increase the sizing effect can thus not be carried too far.

However, despite their several disadvantages, rosin dispersions are widely used and cannot in all circumstances be replaced by synthetic sizing agents. In contrast to synthetic sizing agents, rosin does for example give a good adhesion to yankee cylinders and rosin dispersions can thus be used in paper production wherein such cylinders are used.

Synthetic sizing agents, such as ketene dimers, acid anhydrides, isocyanates and carbamoyl chlorides, react with the cellulose and give an irreversible bond. These sizing agents generally give a very good sizing effect, both to water and other liquids, at small added amounts. They are efficient over a wide pH range and also at a high pH. One disadvantage of the synthetic sizing agents is that they are considerably more expensive than rosin, although this might in several cases be balanced by the higher degree of efficiency at lower amounts. Synthetic sizing agents are added to the stock in the form of charged dispersions and due to the reactivity of the chemicals there is a risk of hydrolysis in water and this leads to problems both to obtain storage stable dispersions and to avoid decreased activity of the dispersions.

It is known to combine rosin and certain synthetic sizing agents, ketene dimers, acid anhydrides and isocyanates, in order to obtain a more widely useful sizing agent, Cationic dispersions containing rosin and the mentioned synthetic sizing agents are disclosed in the European patent application No. 74544. These dispersons contain as the dispersed phase as well particles of rosin as particles of the synthetic sizing agent. The processes for sizing which are disclosed in the European patent application also includes separate addition to the stock of a cationic rosin dispersion and a cationic dispersion of the synthetic sizing agent.

Alum, ie aluminum sulphate with an excess of sulphate ion in relation to aluminum ion, is generally used for formation of an aluminum-rosinate complex both at sizing with solely rosin and at sizing with combinations of rosin and synthetic sizing agents according to the mentioned European patent application. It is also known to use so called polyaluminum salts instead of alum at sizing with rosin. This is for example disclosed in the European patent application No. 85905341.5 which relates to cationic aqueous dispersions which contain the type of aluminum compounds and rosin material.

According to the present invention it has been found that rosin material and certain synthetic sizing agents can be combined in aqueous dispersions with polyaluminum compounds to products which are not only useful in a very wide field as concerns the production of paper products and in which the properties of the respective agents are made use of and increased in a very advantageous manner, but which also give other substantial advantages. The combination of rosin and synthetic sizing agent according to the present invention are aqueous dispersions wherein the particles in the dispersed phase are made up from a mixture of the rosin material and the synthetic sizing agent. Hereby a decrease in the softening point of the rosin material is obtained and this in turn results in a better spreading on the fibres and thus in an improved sizing. This decrease in the softening point of the rosin material and thus in the viscosity of the dispersed phase means that the dispersions can be prepared by substantially lower temperatures which is of economic importance since the costs for heating and plant wear are considerably reduced. With regard to the rosin in the "mixed particles" in the present dispersions it should also be mentioned that the mixing of this with synthetic sizing agent leads to a decreased risk of crystallization and thus to a decreased need of formaldehyde which is normally used in order to lower the crystallization of rosin.

As the particles in the present dispersions are made up from a homogenous mixture of the two materials the synthetic sizing agent will to a great extent be protected by the rosin material and the synthetic agent in the dispersions will thus get a considerably reduced tendency to hydrolysis. Fortified rosin generally has a density greater than 1.05 g/cm$^3$, and the density depends, among other things, on the degree of fortification and impurities. By extending with the synthetic sizing agent, which in itself has a lower density, of about 0.9 to 0.95 g/cm$^3$, the particles in the dispersions will have a density below the density of the rosin material in these. This lowering of the density gives a reduced risk of sedimentation in the dispersions and very stable dispersions can be obtained with "mixed particles" according to the invention.

With regard to the advantages obtained by the actual combination of two different types of sizing agents it should be particularly mentioned that a smaller amount of synthetic sizing agent in the particles of the sizing dispersions give a surprising improvement of the resistance to lactic acid of produced paper. When the combinations contain smaller amounts of rosin and mainly synthetic sizing agent a product is obtained which has a certain adhesion to yankee cylinders and further a better distribution of the synthetic sizing agent over the fibres is obtained. The above discussed improvement in resistance to lactic acid when smaller amounts of synthetic sizing agents are present in the particles is of particular value with regard to the new methods of sterilization which have been developed in later years for milk packages and similar packages. In these methods hydrogen peroxide is used and the resistance to hydrogen peroxide of the synthetic sizing agents, which in themselves give good lactic acid resistance, is not satisfactory while it is satisfactory for rosin material which in itself does not give lactic acid resistance. The present dispersions contain, besides the mixed particles of rosin and synthetic sizing agent, also polyaluminum compounds which further broadens the actual sizing process and means that this can be carried out over a broader pH range and that, for example, a fully satisfactory sizing can be obtained when calcium carbonate is used as filler. It has also surprisingly been found that with the dispersions according to the invention which contain polyaluminum compounds both an improved resistance to acid liquids and an improved resistance to hydrogen peroxide is obtained, compared with if dispersions of mixed particles are used and alum is added to the stock, as conventional, for formation of a rosinate of the rosin in the mixed particles. The present dispersions thus form a one-component system with all necessary chemicals for hydrophobing with combinations of rosin and synthetic sizing agents. As the polyaluminum compounds are present admixed in the dispersions an intimate contact between these and the rosin material is obtained and this means that competing, negative reactions in the stock, formation of precipitations of aluminum hydroxide and negative aluminate ions, do not get sufficient time to occur, but the desired formation of the aluminum-rosinate complex is obtained and thereby improved sizing.

The present invention thus relates to aqueous dispersions wherein the dispersed phase consists of particles which contain a mixture of rosin material and synthetic sizing agent and which dispersions contain a polyaluminum compound wherein each ion contain at least 4 aluminum atoms.

Polyaluminum compounds which are present in the dispersions are per se previously known. They are termed basic and consist of polynuclear complexes. The polyaluminum compounds shall, in aqueous solutions, contain at least 4 aluminum atoms per ion and preferably more than 10. The upper amount of aluminum atoms in the complexes is dependent on the composition of the aqueous phase and can vary, for example depending on the concentration and the pH. Normally the amount is not above 30. The molar ratio of aluminum to counter ion, with the exception of hydroxide ions, should be at least 0.4:1 and preferably at least 0.65:1. Polyaluminum sulphates of this type are for example described in the European patent application No. 62015. As examples of polyaluminum chlorides can be mentioned the basic polyaluminum chloride which is sold under the name Locron and which has the net formula $\{Al_2(OH)_5Cl.5H_2O\}_x$ and which in aqueous solution gives the complex ion $\{Al_{13}O_4(OH)_{24}(H_2O)_{12}\}^{7+}$. It is preferred that the counter ion in the aluminum compound is a chloride or sulphate ion, or mixtures of these, but it is also possible to partly replace these by organic ions such as citrate, tartrate or gluconate ions. It is particularly preferred to use polyaluminum chlorides.

The sizing agent in the dispersions according to the invention can be either mainly rosin material or mainly synthetic sizing agent, and the mixture on which the particles are based suitably contains from 10 to 96 percent by weight of rosin. The synthetic sizing agent is preferably a hydrophobing carbamoyl chloride, ketene dimer or acid anhydride.

The rosin material used in the dispersions according to the invention should have a high free rosin content, ie a high acid number of about 200 and higher, a low content of anhydride derivatives and not be saponified or esterified to any essential extent. Rosin and rosin material herein otherwise refer to known types of rosin such as gum-, wood- and tall oil rosin. The rosin can be crude, refined, proportioned or otherwise modified before it is fortified in a known manner. The fortified rosin can also be treated with eg formaldehyde or iodine to avoid crystallization. As stated earlier the present mixing of the rosin material means that the need of chemicals to decrease crystallization can be reduced, and this is particularly advantageous with regard to the most often used such chemical, ie formaldehyde. The rosin material is preferably fortified rosin, ie rosin reacted with an $\alpha,\beta$-unsaturated polybasic acid or its anhydride, eg fumaric acid, maleic acid, itaconic acid and their anhydrides. Fortified tall oil resin is particularly suitable. Fortified rosin usually contains from about 5 to about 10 percent by weight of adducted acid or anhydride, based on the total weight of the fortified rosin. In combinations according to the present invention such conventionally fortified rosin can of course be used, but also, without any disadvantages, rosin material having higher degree of fortification, up to about 15 percent.

The synthetic sizing agent in the mixed particles in the present dispersions are hydrophobing carbamoyl chlorides, ketene dimers, acid anhydrides or organic isocyanates. These compounds are per se well-known cellulose-reactive sizing agents. Hydrophobing carbamoyl chlorides, which for example are disclosed in the U.S. Pat. No. 3,887,427 have the formula

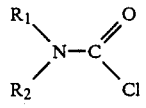

wherein the group $R_1$ is an organic hydrophobic group having from about 8 to about 40 carbon atoms and wherein $R_2$ also is such a group or a lower alkyl group. Suitably both $R_1$ and $R_2$ in the carbamoyl chlorides are organic, hydrophobic groups, particularly alkyl groups having from about 12 to about 30 carbon atoms.

Ketene dimers have the formula

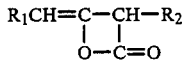

wherein both $R_1$ and $R_2$ are organic, hydrophobic groups, usually alkyl groups.

Acid anhydrides can be characterized by the general formula

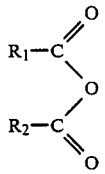

wherein $R_1$ and $R_2$ are organic, hydrophobic groups and usually different such groups. It is possible, per se, to prepare dispersions with mixed particles containing isocyanates as the synthetic sizing agent. It has, however, been found that admixing of these synthetic sizing agents in smaller amounts does not give any substantial influence on either the softening point or the density of the rosin.

According to the present invention it is preferred that the synthetic sizing agent in the mixed particles of the dispersions is a ketene dimer or a carbamoyl chloride, and especially a carbamoyl chloride. Carbamoyl chlorides give a very good influence on the softening point, density and viscosity. Further, dispersions of mixed particles containing carbamoyl chlorides are efficient over broad pH ranges and give very good lactic acid resistance.

In the dispersions of the present invention the dispersed phase consists of particles of a mixture of rosin and synthetic sizing agent whereby the mixture contains from 10 to 96 percent by weight of rosin. As the particles contain a homogenous mixture of the two active sizing agents the weight ratio in each particle in the dispersion will thus be in this range. The particles in the dispersions according to the invention consist essentially of the combination of the two active sizing agents. Minor amounts of inert hydrocarbons, paraffins, can of course also be present. The amount of such should, however, preferably not exceed 25 percent by weight, based on the combination of the active sizing agents.

In the dispersions the polyaluminum compounds are present in an amount of at least 5 percent by weight, calculated as aluminum on the amount of rosin in the dispersions. The upper limit is not critical but can reach 200 percent by weight and more. The amount is suitably within the range of from 20 to 60 percent by weight, based on the rosin material in the dispersions. The pH of the dispersions is usually within the range of from 3.0 to 4.5.

The dispersions of the mixed particles can be anionic, cationic or nonionic and this means that the dispersions of the mixed particles have been produced using the mentioned types of dispersing agents. It is preferred that the dispersions are cationic when they contain smaller amounts of rosin, while dispersions with higher amounts of rosin can be anionic or cationic. For dispersions with higher amounts of rosin the mixture suitably contains between 96 and 80, and preferably between 96 and 90 percent by weight of rosin. For dispersions with lower amounts of rosin and higher amounts of synthetic sizing agent the mixture suitably contains 10 to 60 and preferably 20 to 40 percent of rosin. The first mentioned type of dispersion, ie with mainly rosin is especially preferred as hereby the previously stated advantages with decrease in the softening point of the rosin etc are particularly pronounced. Synthetic sizing agents do in themselves give good resistance to lactic acid for paper and board sized therewith. It has been found that a surprising increase in the lactic acid resistance is obtained with dispersions according to the present invention which contain small amounts of synthetic sizing agents, and which then can be considered as dispersions of modified rosin.

The dry contents, the total amount of sizing agents, of the dispersions should be within the range of from 4 to 25 percent by weight and suitably within the range of from 10 to 20 percent by weight.

Dispersions of mixed particles are prepared using one or several dispersing agents from the groups cationic, anionic and nonionic dispersing agents. The amount of dispersing agent should be sufficient to give the dispersions the desired charge and storage stability and it should usually be at least 2 percent by weight based on the amount of sizing agent. The upper limit is not critical, but normally it is seldom necessary to use more than 5 percent by weight.

The requirements on the dispersion agents are that they give the desired net charge and that they do not have a negative influence on the hydrophobing effect of the dispersions. Anionic dispersing agents can for example be selected from alkyl sulphates, alkyl sulphonates, alkylarene sulphonates etc. Particularly suitable anionic dispersing agents are alkyl sulphates and alkyl sulphonates, eg sodium lauryl sulphate. Cationic dispersing agents can for example be selected from nitrogen containing dispersing agents such as quaternary ammonium compounds and salts of tertiary amines. Quaternary ammonium compounds are particularly suitable cationic dispersing agents. Nonionic dispersing agents can for example be alkoxylated, preferably ethoxylated, alcohols, alkylphenols and fatty acids, partial fatty acid esters of polyvalent alcohols with 2 to 8 carbon atoms, or anhydro derivatives of these, and alkoxylated derivatives of these. Protective colloids or retention agents, such as cationic starch, cellulose derivatives, guar gum, polyacryl amide, polyethyleneimine, polyamine, polyamidoamine, polyethyleneamine or polyacrylate can also be included in the dispersions.

The dispersions of the sizing agents are prepared in per se conventional manner using the technique normally used at the preparation of dispersions of rosin in the form of dispersions with high free rosin content, ie by homogenizing the active substance in water, in the presence of a dispersing agent, using high shear forces and fairly high temperatures so that fine particles, generally with a size below about 0.1 μm, are obtained as the dispersed phase. The active material which is homogenized according to the invention is homogenous mixture of rosin and synthetic sizing agent. The homogenous mixture is preferably prepared by intensive mixing of melted rosin to which the synthetic sizing agent is added. The synthetic sizing agent can be added in solid form to melted rosin and melts at the contact with the rosin. However, it is also possible to obtain a homogenous mixture starting from solutions of the respective materials in solvents. The mixture of rosin and the synthetic sizing agent is dispersed in water in the presence of a dispersing agent under satisfactory agitation, for example by use of a static mixer or an Ultra Turrax equipment. The warm dispersed phase is then homogenized. The process should preferably be carried out continuously and with as short times as possible at elevated temperatures. The obtained dispersion is cooled.

As a homogenous mixture of rosin and synthetic sizing agent is homogenized this means that the total solid substance has a lower softening point than rosin solely and thus that it is possible to use substantially lower temperatures and pressures at the homogenization compared with what is used at the production of conventional rosin dispersions. This is advantageous not only with regard to decreased need for heating and reduced plant wear but also with regard to the stability of the systems. At the preparation of dispersions according to the present invention the temperature at the homogenization can suitably be kept below 100° C., and the homogenization is carried out at normal pressure.

The polyaluminum compounds are incorporated in the dispersions of the mixed particles either at the production of these according to what has been disclosed above or are added separately to the thus prepared dispersions, after the preparation of the dispersions or in connection with their use in paper making. It is hereby surprising that polyaluminum compounds can be incorporated also in anionic dispersions of the combination of rosin and synthetic sizing agent, and this also at fairly high solid contents. This makes it possible to obtain a stronger bond between the synthetic sizing agents and the polyaluminum compounds, which in turn results in an improved sizing effect.

The invention also relates to a process for the production of an aqueous dispersion containing a mixture of rosin and synthetic sizing agent, whereby a homogenous mixture of rosin and synthetic sizing agent is prepared, which mixture is then dispersed in water in the presence of a dispersing agent and whereby this is carried out in the presence of a polyaluminum compound, or alternatively that a polyaluminum compound is added to an aqueous dispersion of mixed particles.

The mixing of the phases, dispersion etc can be carried out as described above and using the above mentioned dispersing agents. The particles in the obtained dispersions will be made up from a mixture of the two active sizing agents substantially in the proportions in which the phases have been mixed. The particles will further have a density which is below the density of the used fortified rosin material. The dry content, the content of rosin and synthetic sizing agent, in the dispersions is suitably within the range of from 4 to b 25 percent by weight. The polyaluminum compounds are added to give the amounts stated above with regard to the amount of rosin.

The obtained dispersion have very good stability as the particles in the dispersed phase all have the same density and as the synthetic sizing agent to a great extent will be protected by the rosin material and thereby get a lowered tendency to hydrolysis and the dispersions containing polyaluminum compounds form a complete one-component sizing system.

The present dispersions are particularly suitable for sizing of paper, board, paper board and similar cellulose fibre products and thus use forms part of the present invention. The dispersions can be used for internal sizing and surface sizing. The dispersions are preferably used for internal sizing and are then added in a conventional manner to a cellulose stock and conventionally used chemicals at paper production, such as retention agents, fillers, wet strength resins etc, can of course be used with the present dispersions. Paper chemicals such as retention agents can, if desired, also be incorporated in the actual dispersions. The dispersions are suitably used in amounts corresponding to 0.05 to 1 percent by weight of sizing agent, based on the cellulose fibres.

The invention is further illustrated in the following examples, which, however, are not intended to limit the same. Parts and percent relate to parts by weight and percent by weight respectively, unless otherwise stated.

EXAMPLE 1

50 parts of fortified tall oil resin were heated to 150° C. and 20 parts of paraffin were then added under agitation. The temperature was lowered to 65° C. and 9 parts of distearyl carbamoyl chloride were then added and the mixture cooled to room temperature. 30 parts of this mixture were warmed to 40° C. and 720 parts of water containing 1.5 parts of distearyl dimethylammonium chloride were added under vigorous agitation during 60 seconds in an Ultra Turrax. The dispersion was then rapidly cooled and divided into two portions. The pure dispersion was evaluated below as number 1A. To 375 parts of dispersion 375 parts of a 4% solution of polyaluminum chloride, sold by Hoechst under the trade name Locron, were added and evaluated as dispersion 1B with a pH of 3.3.

EXAMPLE 2

30 parts of sizing agent composition according to Example 1 were dispersed with 720 parts of water containing 1.6 parts of distearylamine hydrochloride, during 90 seconds at 35° C., dispersion 2A. To half of this, 375 parts, 375 parts of a 4% solution of polyaluminum chloride, sold by Hoechst under the trade name Locron, were added. This mixture gave dispersion 2B with a pH of 3.1.

EXAMPLE 3

40 parts of the sizing agent composition of Example 1 were warmed to 32° C. 720 parts of aqueous phase containing 2 parts of cationic starch and 40 parts of polyaluminum chloride, sold by Hoeschst under the trade name Locron, were warmed to 28° C.

To the sizing agent composition 2 parts of monostearyl glyceride were first added and the aqueous phase was then added under vigorous agitation during 90 seconds. The pH of the finished dispersion was 3.3.

EXAMPLE 4

40 parts of the sizing agent composition of Example 1 were warmed to 34° C. and dispersed for 105 seconds in 720 parts of aqueous phase containing 3.2 parts of sodium lauryl sulphate, evaluated as 4A. 100 parts of a dispersion according to this example were added to 100 parts of a 5% aqueous solution of polyaluminum chloride, sold by Hoechst under the trade name Locron, and evaluated as 4B. The pH of the dispersions were 3.7 for 4A and 3.4 for 4B.

EXAMPLE 5

50 parts of fortified tall oil rosin were heated to 150° C. and 20 parts of paraffin were then added under agitation. The temperature was lowered to 65° C. and 14 parts of distearyl carbamoyl chloride were then added and the mixture cooled to room temperature. 32 parts of this phase were warmed to 37° C. and 750 parts of aqueous phase containing 1.5 parts of distearylamine hydrochloride were then added under vigorous agitation. This dispersion 5A had a pH of 3.8.

When the dispersion had been cooled to room temperature 750 parts of a 4% solution of polyaluminum chloride, sold by Hoechst under the trade name Locron, were added, dispersion 5B with a pH of 3.3

EXAMPLE 6

18 parts of distearyl carbamoyl chloride were warmed to 40° C. and 82 parts of aqueous phase, 40° C., containing 1.0 part of methylhydroxyethyl cellulose and 0.6 parts of polyethyleneimine were then added under vigorous agitation during 120 seconds. Dispersion 6A with a pH of 4.2. The procedure was repeated with distearylketene dimer instead of carbamoyl chloride and this gave dispersion 6B with a pH of 4.5

EXAMPLE 7

35 parts of fortified tall oil rosin were dispersed in a high pressure homogenizer with 65 parts of water containing 1.1 parts of sodium laurylsulphate at 160° C.

This dispersion was evaluated as 7A and had a pH of 3.4. A 10% dilution of this dispersion was added to a solution of 10% polyaluminum chloride, sold by Hoechst under the trade name of Locron, and the mixture, which had a pH of 3.2, was evaluated as dispersion 7B.

EXAMPLE 8

Paper sheets with a basis weight of 190 g/m$^2$ were prepared from bleached sulphate pulp at a pH of 4.5 according to the standard method SCAN-S23X for laboratory scale. In the table below are shown Cobb-values measured according to TAPPI standard T 441 OS-63, edge penetration for 1% lactic acid at 25° C., 60 minutes, according to standard from TETRA-pak and edge penetration for 35% $H_2O_2$-solution at 70° C. during 10 minutes according to a process recommended by TETRA-pak. To rosin dispersions and mixed dispersions without polyaluminum chloride 3% alum were added separately. Dispersions of solely synthetic sizing agent were evaluated without aluminum compound.

| Dispersion No. | Cobb$_{60}$ g/m$^2$ | Absorbed amount in kg/m$^2$ edge surface | |
|---|---|---|---|
| | | lactic acid | $H_2O_2$ |
| 7A | 17 | 0.76 | 0.55 |
| 6B | 18 | 0.32 | 0.96 |
| 6A | 18 | 0.33 | 0.90 |
| 1A | 18 | 0.48 | 0.66 |
| 1B | 16 | 0.34 | 0.56 |
| 2A | 17 | 0.46 | 0.78 |
| 2B | 17 | 0.40 | 0.70 |
| 3 | 18 | 0.41 | 0.76 |
| 4A | 16 | 0.34 | 0.54 |

-continued

| Dispersion No. | Cobb$_{60}$ g/m$^2$ | Absorbed amount in kg/m$^2$ edge surface | |
|---|---|---|---|
| | | lactic acid | $H_2O_2$ |
| 4B | 17 | 0.32 | 0.50 |

EXAMPLE 9

Paper sheets were prepared and evaluated as in Example 8 but this time with unbleached sulphate pulp and at different pH in the stock.

| Dispersion No. | pH | Cobb$_{60}$ g/m$^2$ | Absorbed amount in kg/m$^2$ edge surface | |
|---|---|---|---|---|
| | | | lactic acid | $H_2O_2$ |
| 7A | 4.5 | 19 | 0.94 | 0.63 |
| 7B | 4.5 | 17 | 0.80 | 0.59 |
| 7A | 6.0 | 36 | — | — |
| 7B | 6.0 | 20 | 1.05 | 0.83 |
| 7A | 7.5 | >100 | — | — |
| 7B | 7.5 | 22 | 1.25 | 1.10 |
| 6A | 4.5 | 19 | 0.25 | 0.98 |
| 6A | 6.0 | 18 | 0.23 | 0.89 |
| 6A | 7.5 | 18 | 0.22 | 0.77 |
| 3 | 4.5 | 18 | 0.41 | 0.76 |
| 3 | 6.0 | 20 | 0.44 | 0.80 |
| 3 | 7.5 | 22 | 0.50 | 0.96 |

EXAMPLE 10

Paper sheets from unbleached sulphate were prepared and evaluated according to Example 8. For the dispersions which did not contain polyaluminum chloride corresponding amount of this were added separately to the stock immediately after the addition of the sizing agent at a pH of 4.5.

| Dispersion No. | Cobb$_{60}$ g/m$^2$ | Absorbed amount in kg/m$^2$ edge surface | |
|---|---|---|---|
| | | lactic acid | $H_2O_2$ |
| 4A | 18 | 0.40 | 0.74 |
| 4B | 16 | 0.32 | 0.54 |
| 5A | 16 | 0.32 | 0.66 |
| 5B | 16 | 0.29 | 0.63 |

EXAMPLE 11

Paper sheets were prepared according to Example 9 at a pH of 3.6. At evaluation of dispersion 4A 2.0% alum, calculated as dry on dry cellulose, were added.

| Dispersion No. | Cobb$_{60}$ g/m$^2$ | Absorbed amount in kg/m$^2$ edge surface | |
|---|---|---|---|
| | | lactic acid | $H_2O_2$ |
| 4A | 22 | 0.50 | 0.93 |
| 4B | 18 | 0.42 | 0.65 |

EXAMPLE 12

40 parts of sizing agent composition from Example 5 were warmed to 30° C. and dispersed for 90 seconds with 360 parts of aqueous phase containing 3.4 parts of sodium laurylsulphate.

1 part of polyaluminum sulphate with 17.3% Al and OH/Al=1.7 was dissolved in 2 parts of water under heating to 50° C. 28 parts of the dispersed hydrophobing composition were dropped into 10 parts of polyaluminum sulphate solution under good agitation. The obtained dispersion had a pH of 3.9.

EXAMPLE 13

Paper sheets were prepared and evaluated as in Example 8 but using unbleached sulphate pulp and a pH of 7.5 in the stock.

| Dispersion | $Cobb_{60}$ g/m² | Absorbed amount in kg/m² edge surface | |
|---|---|---|---|
| | | lactic acid | $H_2O_2$ |
| 7A | >100 | | |
| 7B | 22 | 1.25 | 1.10 |
| 12 | 20 | 0.51 | 0.83 |

EXAMPLE 14

From a polyaluminum compound, sold by AB CDM under the trade name Ekoflock and containing 5.8% Al, 10% Cl and 2.0% $SO_4$, a 10% solution, number 14A, was prepared. From a polyaluminum compound, sold by Hoechst under the trade name Locron and with the formula $Al_2(OH)$hd 5Cl.5$H_2O$, a 10% solution, number 14B, was prepared.

To 1.2 parts of solution 14A 1 part of dispersion according to Example 5, but with a dry content of 10%, was added under good agitation. This dispersion 14D had a pH of 3.2.

EXAMPLE 15

Paper sheets were prepared and evaluated as in Example 8 using unbleached sulphate pulp at a pH of 4.5.

| Dispersion | Cobb | Absorbed amount in kg/m² edge surface | |
|---|---|---|---|
| | | lactic acid | $H_2O_2$ |
| 11 | 16 | 0.28 | 0.57 |
| 14C | 17 | 0.31 | 0.62 |
| 14D | 16 | 0.29 | 0.63 |

EXAMPLE 16

Paper sheets were prepared according to Example 9 at a pH of 4.5. For the dispersions which did not contain any aluminum compound 3% alum, calculated as dry on dry cellulose, were added separately.

| Dispersion | Cobb g/m² | Absorbed amount in kg/m² edge surface | |
|---|---|---|---|
| | | lactic acid | $H_2O_2$ |
| 2A | 18 | 0.51 | 0.75 |
| 2B | 17 | 0.40 | 0.70 |
| 4A | 19 | 0.55 | 0.79 |
| 4B | 17 | 0.32 | 0.50 |

We claim:

1. Aqueous dispersion, characterized in that the dispersed phase consists of particles which contain a homogenous mixture of rosin material and a synthetic sizing agent and in that the dispersion contains a polyaluminum compound wherein each ion contains at least 4 aluminum atoms.

2. A dispersion according to claim 1, characterized in that the mixture of rosin material and synthetic sizing agent contains from 10 to 96 percent by weight of rosin material.

3. A dispersion according to claim 1, characterized in that the synthetic sizing agent is a carbamoyl chloride or a ketene dimer.

4. A dispersion according to claim 1, characterized in that the polyaluminum compound is polyaluminum chloride or polyaluminum sulphate.

5. A dispersion according to claim 1, characterized in that the molar ratio of aluminum to counter ion, with the exception of hydroxide ions, in the polyaluminum compound is at least 0.4:1.

6. A dispersion according to claim 1 characterized in that the polyaluminum compound is present in the dispersion in an amount of from 5 to 200 percent by weight, calculated as aluminum on rosin material.

7. A method for the preparation of an aqueous dispersion containing a homogenous mixture of rosin and synthetic sizing agent, characterized in that a homogenous mixture containing rosin material and synthetic sizing agent is prepared, whereafter the homogenous mixture is dispersed in water in the presence of a dispersing agent, whereby a polyaluminum compound, wherein each ion contains at least 4 aluminum atoms, is present at the dispersing or, alternatively, is added to the prepared dispersion.

8. A method according to claim 7, characterized in that the homogenous mixture which is prepared contains 10 to 96 percent by weight of the rosin material and 4 to 90 percent by weight of the synthetic sizing agent.

9. A method according to claim 7, characterized in that the synthetic sizing agent is a ketene dimer or a carbamoyl chloride.

10. A method of sizing paper, paper board, board and similar cellulose fibre products which comprises applying to these or to a stock for these products an aqueous dispersion wherein the dispersed phase consists of particles which contain a homogenous mixture of (a) rosin material and (b) a synthetic sizing agent and which dispersion contains a polyaluminum compound, wherein each ion of the polyaluminum contains at least 4 aluminum atoms.

11. A dispersion according to claim 1 wherein said synthetic sizing agent is selected from the group consisting of hydrophobing carbamoyl chlorides, ketene dimers, acid anhydrides and organic isocyanates.

12. A method according to claim 7 wherein said synthetic sizing agent is selected from the group consisting of hydrophobing carbamoyl chlorides, ketene dimers, acid anhydrides and organic isocyanates.

13. A method according to claim 10 wherein said synthetic sizing agent is selected from the group consisting of hydrophobing carbamoyl chlorides, ketene dimers, acid anhydrides and organic isocyanates.

* * * * *